US005407029A

United States Patent [19]

Salmon et al.

[11] Patent Number: 5,407,029

[45] Date of Patent: Apr. 18, 1995

[54] ELEVATOR LANDING

[75] Inventors: John K. Salmon, South Windsor, Conn.; Antoine Fritsch, Paris, France

[73] Assignee: Otis Elevator Company, Farmington, Conn.

[21] Appl. No.: 146,671

[22] Filed: Nov. 1, 1993

[51] Int. Cl.[6] ..... B66B 13/06

[52] U.S. Cl. ..... 187/340; 187/336; 187/414; 49/40; 49/118; 49/122

[58] Field of Search ..... 187/1 R, 52 LC, 62, 187/65, 414, 325, 330, 336, 340; 49/40, 109, 116, 118, 122

[56] References Cited

U.S. PATENT DOCUMENTS

| | | | |
|---|---|---|---|
| 1,874,562 | 8/1932 | Mariotti . | |
| 3,193,270 | 10/1975 | Kumagai | 187/521 C X |
| 4,693,033 | 9/1987 | Tauzin | 49/122 |

FOREIGN PATENT DOCUMENTS

| | | | |
|---|---|---|---|
| 296822 | 5/1932 | Italy . | |
| 300295 | 9/1932 | Italy . | |
| 398980 | 4/1991 | Japan | 187/1 R X |
| 4182295 | 6/1992 | Japan | 187/52 C X |

OTHER PUBLICATIONS

Icar—Creation & Design De Produits–Released 1992, pp. 24–58.

*Primary Examiner*—Cheryl L. Gastineau
*Assistant Examiner*—Dean A. Reichard

[57] ABSTRACT

An elevator landing, which is used with a curvilinear hoistway door has a lintel, a guide attached to the lintel, the guide having a curvilinear slot having an inner edge and an outer edge for guiding an upper portion of the curvilinear door and, a curvilinear sill having a curvilinear second slot having an inner edge and an outer edge for guiding a lower edge portion of the doors. The first slot and the second slot are in register with each other. The sill slot extends vertically through the sill.

14 Claims, 7 Drawing Sheets

ELEVATOR LANDING

BACKGROUND OF THE INVENTION

1. Technical Field

This device relates to elevators in general and to a new elevator landing in particular.

2. Background Art

Elevators have doors that have been configured in basically the same ways for many years: each elevator car has one or more center or side opening doors to protect passengers as the car moves; and each landing has one or more hoistway doors that are configured similarly to the car doors to prevent passengers from entering the hoistway when the car is not at the landing. Some landings utilize a single hoistway door that pivots open and shut like a house door.

Hoistway and car doors are supported similarly. The doors are suspended from their upper edges by rollers that travel longitudinally in a track attached to a lintel. The doors are guided at their bottom edges by gibs that slide in a closed bottom slot in a sill. The doors slide in a plane perpendicular to a landing opening.

For safety reasons, hoistway doors are required to close automatically. A spring device may be used to close the doors or a weight is attached to the doors by a cable that travels over a series of pulleys. The weight forces the doors to close unless there is a countervailing force.

The hoistway and car doors are opened and closed by a door operating unit. The unit is disposed atop an elevator car and is attached to each car door via a complicated mechanical linkage. Each car door, in turn, is coupled, at the proper time, by a pair of rollers that clamp a vane attached to the hoistway doors.

DISCLOSURE OF THE INVENTION

It is an object of the invention to provide a new elevator landing that minimizes the need for door maintenance and repair.

According to the invention, an elevator landing that is used with a curvilinear hoistway door has a lintel, a guide attached to the lintel, the guide having a curvilinear slot having an inner edge and an outer edge for guiding an upper portion of the curvilinear door and, a curvilinear sill having a curvilinear second slot having an inner edge and an outer edge for guiding a lower edge portion of said doors. The first slot and the second slot are in register with each other.

According to a feature of the invention, an upper portion and a lower portion of each of the hoistway doors travels in, and is guided along, a path of the hoistway doors by a slot following the guide and sill and extending vertically through the sill. Contact of the hoistway doors is normal to the arcuate path of the slot.

According further to the invention, an elevator landing has a lintel, a guide attached to the lintel, the guide having a first slot having an inner edge and an outer edge for guiding an upper portion of a hoistway door and, a sill having a second slot having an inner edge and an outer edge for guiding a lower edge portion of the door, the second slot extending vertically through the sill. The first slot and the second slot are in register with each other. This invention provides several advantages. By guiding the hoistway doors themselves in an open bottom slot, gibs are eliminated. Gibs are subject to sticking in their slots and may be impeded by dirt and other debris that accumulates in their closed bottom slots. By guiding the hoistway door in a slot in which contact is normal to the path of the slot, tracks and rollers are eliminated thereby minimizing the number and types of parts that might fail and, the possibility of the doors sticking during travel is minimized.

These and other objects, features, and advantages of the present invention will become more apparent in light of the following detailed description of a best mode embodiment thereof, as illustrated in the accompanying drawing.

BEST MODE FOR CARRYING OUT THE INVENTION

Figure 1:
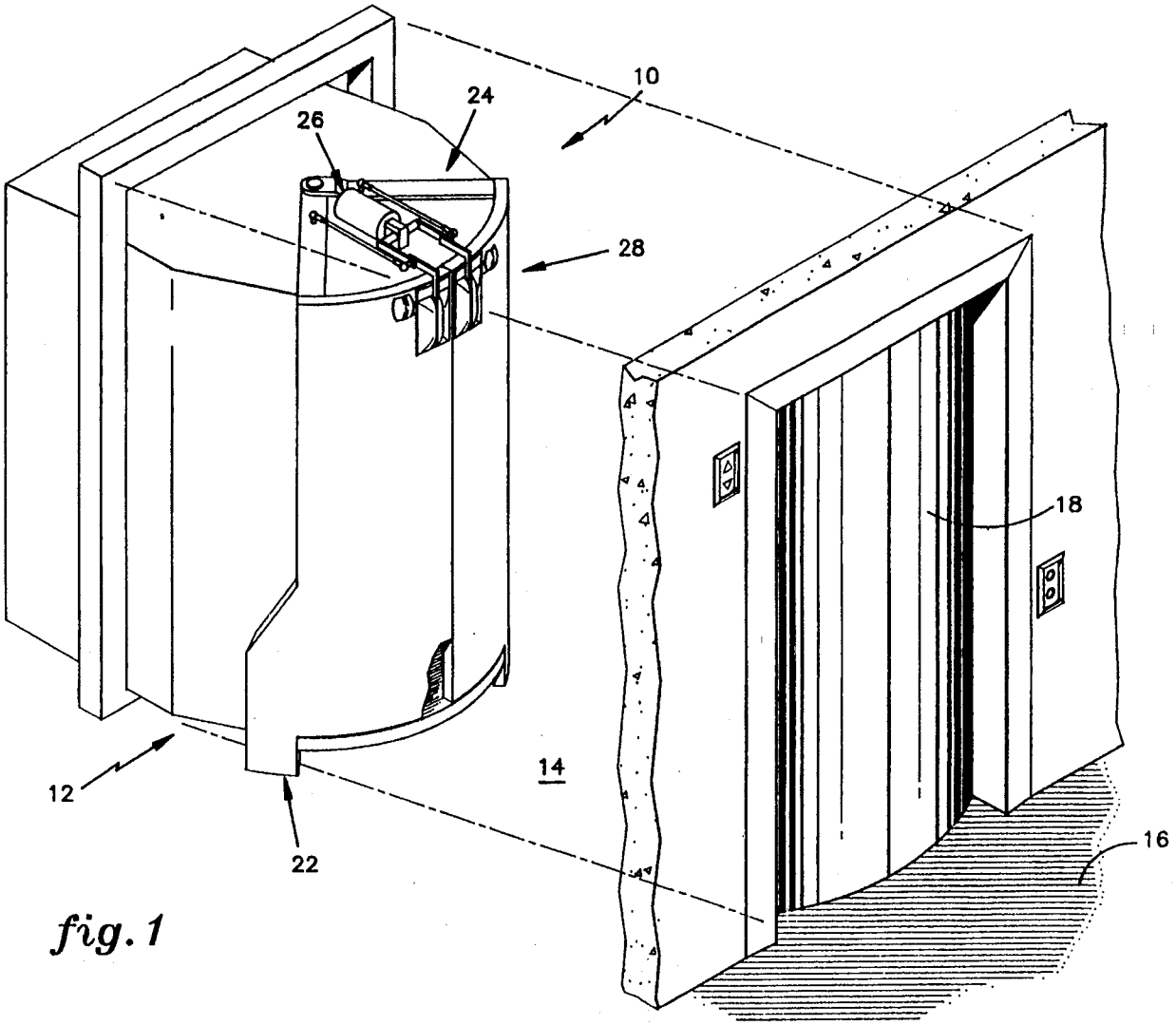
FIG. 1 is a diagrammatic view of the elevator door system of the present invention.

Referring to FIG. 1, an embodiment of the elevator door system 10 incorporating the concepts of the invention is shown. This specific embodiment of the door system 10 is intended for use with an elevator car 12 travelling within a hoistway 14. The elevator car 12 may be driven within the hoistway 14 by a variety of driving systems including, but not limited to, hydraulic, traction, and linear motor driving systems (not shown). One of ordinary skill in the art will recognize that this door system 10 has utility with other types of enclosures as well.

Figure 4:
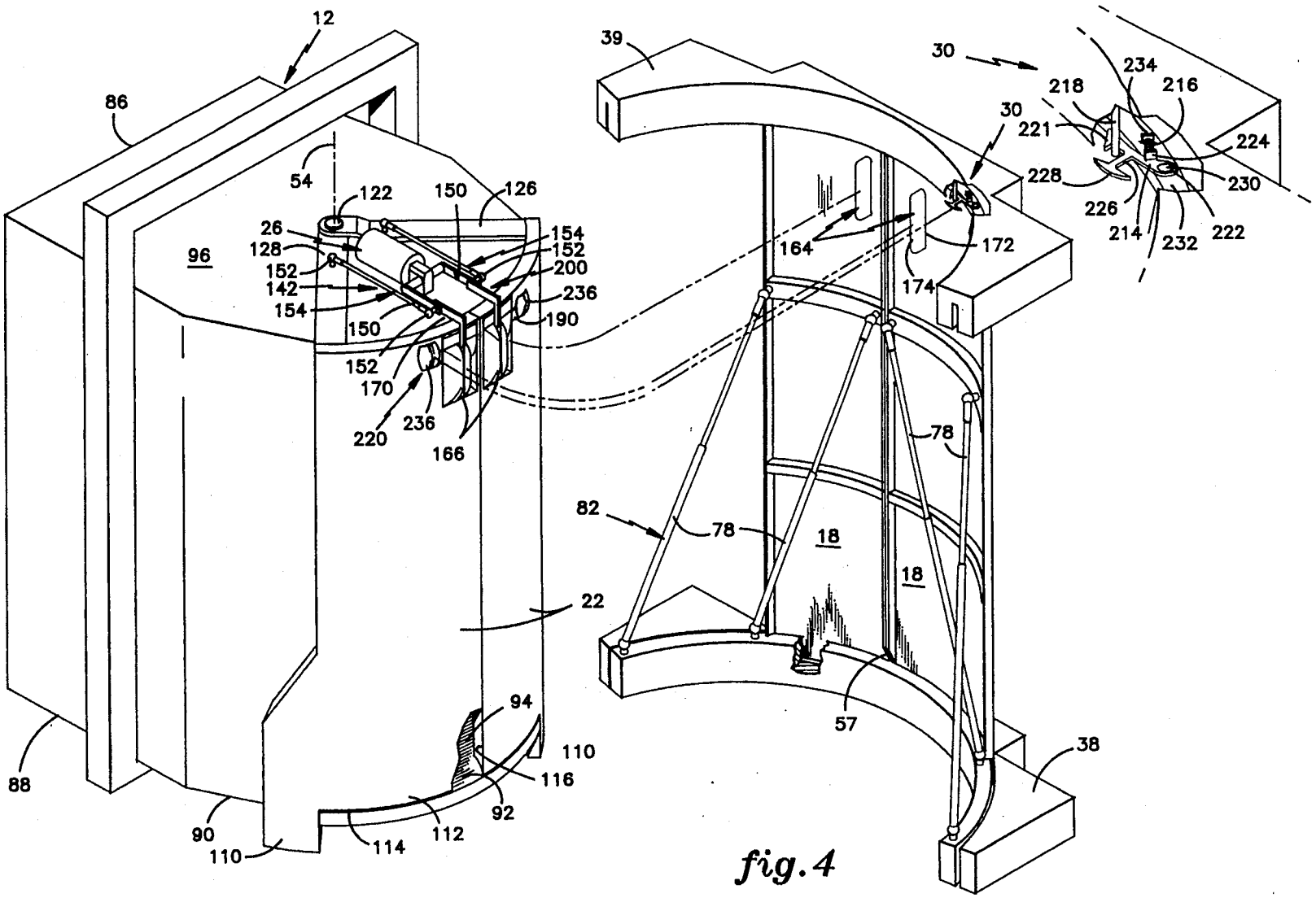
FIG. 4 is a perspective view of the elevator car and hoistway doors shown in FIG. 1.

The elevator door system 10 comprises the following subsystems: a landing 16, hoistway doors 18, hoistway door suspension 20 (see FIG. 2), the elevator car 12, car doors 22, car door suspension 24, a drive 26, and a hoistway/car door coupling 28, and a hoistway door lock 30 (see FIG. 4).

The Landing

Figure 2:
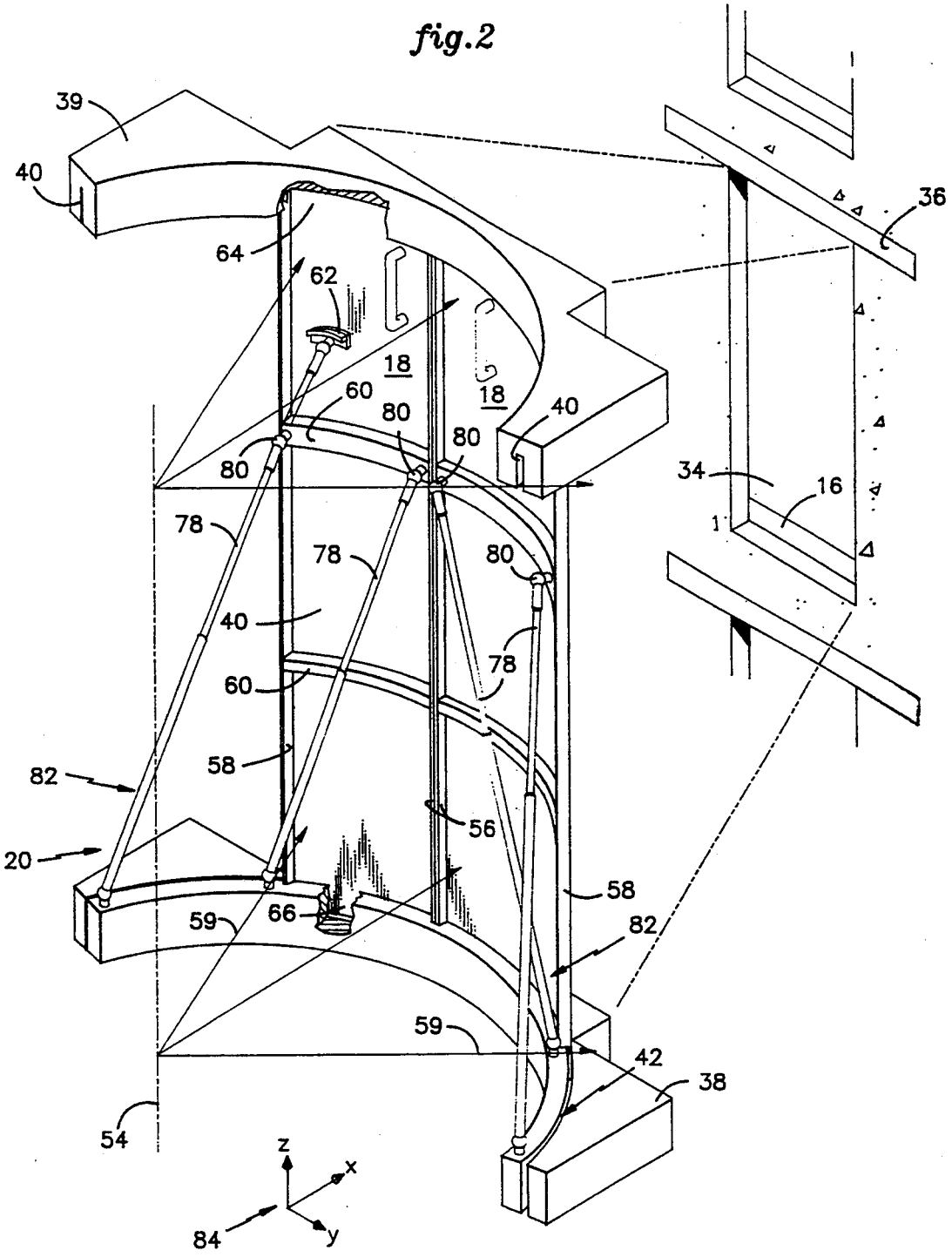
FIG. 2 is a diagrammatic view of hoistway doors shown in FIG. 1.

Referring to FIG. 2, access to the elevator car 12 (see FIG. 1) on each floor is provided through a hoistway door(s) 18 mounted in a standard width landing opening 34. The landing opening height is defined by an overhead support member, or "lintel" 36, on the top and a sill 38 extending across the opening on the bottom. The lintel 36, disposed over the landing opening 34, may be curvilinear or straight depending upon the aesthetic application. The lintel 36 covers a guide 39 attached to the hoistway 14 (see FIG. 2) by conventional means. The guide 39 includes a curvilinear first slot 40 for guiding a top portion of the hoistway doors 18 as will be discussed infra. The sill 38 is curvilinear and has a curvilinear second slot 42 for guiding a bottom portion of the hoistway doors 18. The first 40 and second slots 42 are vertically in register with each other.

Referring to FIG. 2, in another embodiment, the second slot 42 passes completely through the sill 38. The open second slot 42 allows debris to pass through into the hoistway that would otherwise impede the motion of the hoistway doors 18.

Each curvilinear section (except for the inner radius) has a constant radius emanating from an axis 54 extending through the elevator car (see FIG. 4 also).

The Hoistway Doors

Referring to FIG. 2, each hoistway door 18 has a panel with a constant radius cross-section that faces the landing 16. The origin of the radius is an axis 54 extending through the elevator car. Each door 18 has a leading edge 56 which faces the opening 34 and a trailing edge 58 which faces away from the opening 34. The leading 56 and trailing 58 edges lie widthwise in planes which intersect at the aforementioned origin; i.e. planes along a radius 59 drawn at each end of the door 18. Reinforcing ribs 60 are conventionally attached to a side of the door 18 facing the hoistway 14. Support brackets 62 may also be conventionally attached to the hoistway door 18.

Each panel 18 has a curvilinear first plate 64 formed integrally therewith that extends upwardly into the first slot 40 in the guide 39. The first plate 64 is shaped so that it may translate within the first slot 40 without binding therein. In one embodiment, a plurality of anti-friction pads (not shown) are attached to the first plate 64 to facilitate motion within the first slot 40. Clearance above the first slot 40, allows the first plate 64 to rise as it travels in the slot 40 without interference, as will be discussed infra. Each door 18 further includes a curvilinear second plate 66 formed integrally therewith that extends downwardly into the second slot 42 in the sill 38. The second plate 66 is shaped so that it may translate within the second slot 42 without binding therein. Clearance below the second slot 42 allows the second plate 66 to travel downward as the hoistway doors 18 open without interference, as will be discussed infra.

In one embodiment, the leading edges 56 of the hoistway doors 18 include curved surfaces 57 at the bottom to deflect foreign objects from underneath during closing.

The Hoistway Door Suspension

Referring to FIG. 2, each hoistway door 18 suspension system includes a pair of rods 78 attached to the landing sill 38 and the hoistway door 18 by three-degree of freedom couplings 80. On one end, the rod 78 and coupling 80 assemblies are attached to the landing sill 38 on the hoistway side of the door 18, outside of the landing opening 34. On the other end, the rod 78 and coupling 80 assemblies are attached to either a reinforcing rib 60 of the hoistway door 18, or to support brackets 62. The couplings 80 fixed to the rib 60 (or the bracket 62) extend down from the rib 60 to meet the rods 78. The couplings 80 are spaced apart the same distance on the door 18 and the landing sill 38. Hence, the rods 78 and couplings 80 form parallel linkages 82 on each hoistway door 18. A person of skill in the art will recognize that the linkages 82 are not strictly parallel throughout the entire arcuate path of the door.

In the preferred embodiment the couplings 80 are ball and socket type couplings. Alternatively, the couplings 80 may comprise an elastomeric material, a universal joint, or a combination thereof. The couplings allow motion both vertically and horizontally, in planes defined by "X", "Y", and "Z" orthogonal axes 84. The exact motion includes rotational motion in those planes, about the axis of each rod 78.

The position of the parallel linkage 82 of each door suspension relative to the door 18 and the weight of the door 18 always bias the hoistway door 18 toward the closed position, regardless of the initial position of the door. Specifically, the length and positioning of the rods 78 prevent the door 18 from reaching the highest vertical point in its arcuate path. When the door 18 is not restrained, therefore, gravity forces the door 18 back down the arcuate path, toward the closed position.

A person of skill in the art will recognize that the parallel linkage 82 disclosed heretofore may be alternatively mounted a number of different ways and still provide the advantages of minimal moving parts, biased closing, etc. For example, the parallel linkage 82 may be attached above the door (not shown). In that case, the linkage 82 may be attached to a bracket or guide (not shown) which is attached to the top of the door, rather than directly to the door, to avoid interference in the opened position. Alternatively, the parallel linkage 82 may have a bent geometry (not shown) which allows the linkage to be attached to the center of the door 18, and still avoid interference in the opened position. For example, the rods 78 of the linkage 82 might have a geometry of at least two straight segments (not shown) at an angle to one another. The upper segment attached to the hoistway would extend in a direction away from the landing opening and the second segment would extend in a direction back toward and attach to the center of the door. A bent geometry might also be helpful to facilitate the biased closing.

The Car

Figure 3A:
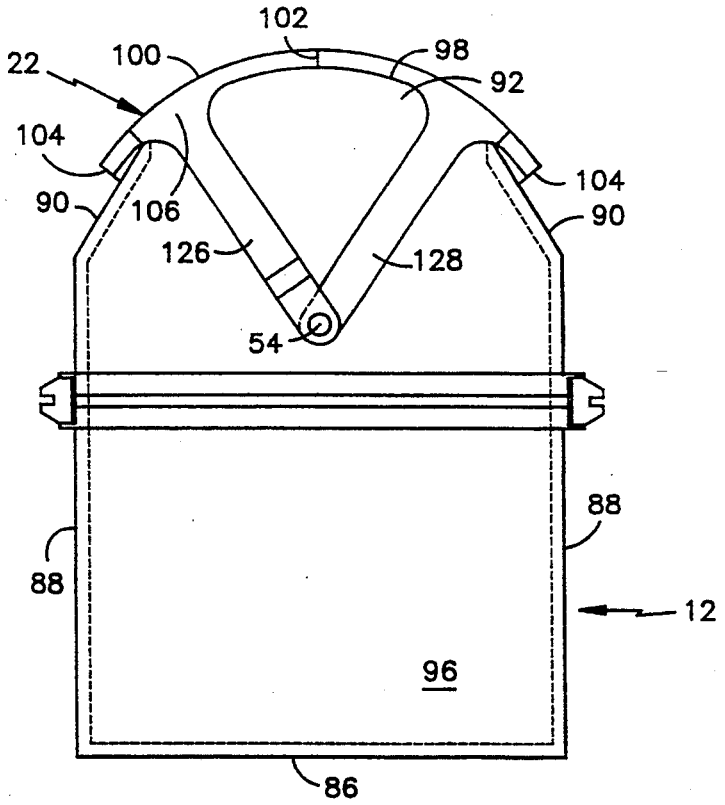
FIG. 3A is a diagrammatic top view of the elevator car shown in FIG. 1.

Referring to FIG. 3A and B, the elevator car 12 has a back wall 86, two side walls 88, two angled front walls 90, an entryway 92, a floor 94 and a ceiling 96. As is known in the art, the back wall 86 attaches at right angles to each side wall 88. Each side wall 88 connects to an angled front wall 90 that tapers inwardly from the side wall 88 towards the entryway 92. The angled front walls 90 are at an angle to give the car doors 22 space to pivot (as will be discussed infra) and define the entryway 92 therebetween. A person of skill in the art will recognize that the front walls may be curved instead of angled. Each wall attaches at its bottom edge to the floor 94 and at its top edge to the ceiling 96 as is known in the art.

The floor 94 has a curvilinear portion at the entryway 92 that arcs from a hoistway side of one of the angled front 90 walls to the other angled front wall 90. When the car 12 is at a landing 16 (see FIG. 2), the curvilinear portion is in close proximity to the landing sill 38 (see FIG. 2), leaving sufficient clearance between the sill 38 and the floor 94.

Referring to FIG. 4, according to an embodiment of the invention, the curvilinear entry portion of the floor 94 extends beyond the hoistway side of the angled front walls 90 and under the path of the car doors 22 to minimize the gap between the floor 94 and the landing sill 38 as will be discussed infra.

Car Doors

Referring to FIGS. 3A and B, the elevator car doors 22 each have a car side 98 and a landing side panel 100 connected by a leading edge flange 102, a trailing edge flange 104, a top flange 106 and a bottom flange 108. Similar to the hoistway doors 18, the car 98 and landing side panels 100 are curved along a constant radius whose origin 54 is an axis of rotation extending through the elevator car 12. The leading 102 and trailing 104 edge flanges lie widthwise in planes which intersect at the aforementioned origin 54; i.e. planes along a radius drawn at each end of the door (see also FIG. 2).

Referring to FIG. 4, according to an embodiment of the invention, a lower portion of each car door 22 has a trailing portion 110 that extends below the floor 94 of the car 12 and a leading portion 112 having its bottom flange 114 just above the floor 94 of the car 12. The leading portion 116 of each door 22 is dimensioned to extend from the outer edge of the entryway 92 to the center of the entryway 92. The leading portion 116 is in register with the curvilinear front portion of the floor 94 extending beyond the hoistway side of the front walls 90.

Car Door Suspension

Figure 3B:
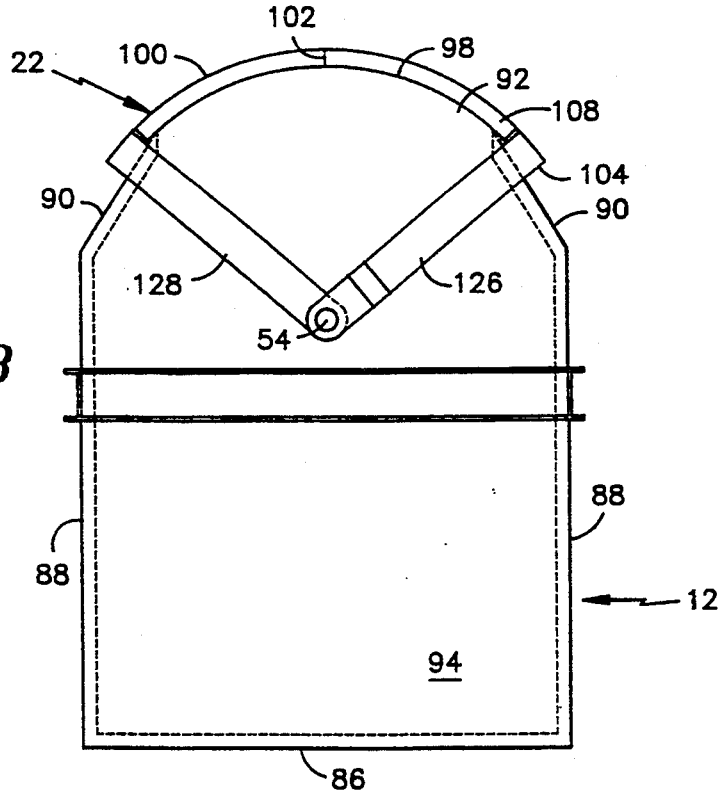
FIG. 3B is a bottom view of the elevator car shown in FIG. 3A.
Figure 5:
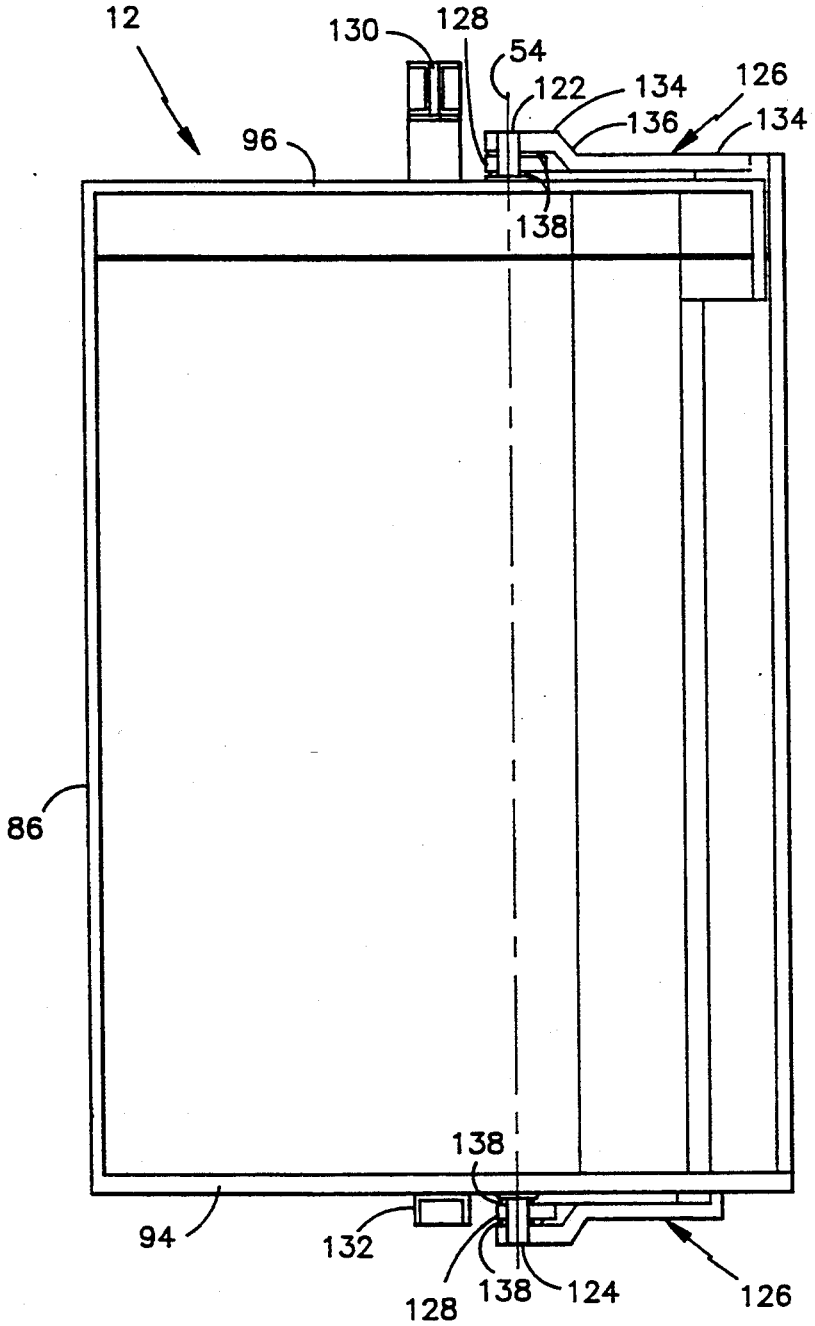
FIG. 5 is a diagrammatic side view of the elevator car shown in FIG. 1.

Referring to FIG. 5, the car door 22 suspension comprises a first 122 and second pivot 124, a pair of first support arms 126 and a pair of second support arms 128 (see also FIGS. 3A and 3B). The first pivot 122 is conventionally anchored above the ceiling 96 of the car 22 and the second pivot 124 is conventionally anchored below the floor 94 of the car 22. Alternatively, the pivots 122,124 may be mounted to the crosshead 130 and safety plank 132 of the car frame (mounting not shown). The pivots 122,124 are coaxial with one another, and therefore define the axis 54 passing through the car 12.

Each support arm 126,128 is pivotly attached to either the first pivot 122 or second pivot 124 on one end and conventionally attached to either the top or bottom portion of a car door 22 on the other end, respectively. Each first support arm 126 includes two parallel sections 134 connected by a jog 136. The jog 136 places the first 126 and second 128 support arms in different planes of rotation at the pivots 122,124 and therefore allows the support arms 126,128 to pivot coaxially as the doors 22 open and close.

Bearings facilitate the movement of the support arms about the pivots. In the preferred embodiment, bearings 138 are positioned between the base of the pivot 122,124 and a support arm 126,128 and between the support arms 126,128. Alternatively, low friction spacers (not shown) may be placed between the support arms 126,128 and around the pivots 122,124 to reduce friction and the need for maintenance. The bearings 138 may be constructed of a self-lubricating plastic to further minimize maintenance and wear and to reduce noise. A person of skill in the art will recognize that the support arms 126,128 may be mounted on the pivots 122,124 in a variety of different ways and thereby permit a variety of different bearings 138, mounted in a multitude of ways, to be used alternatively to facilitate the rotational movement of the doors 22.

Drive

Figure 6B:
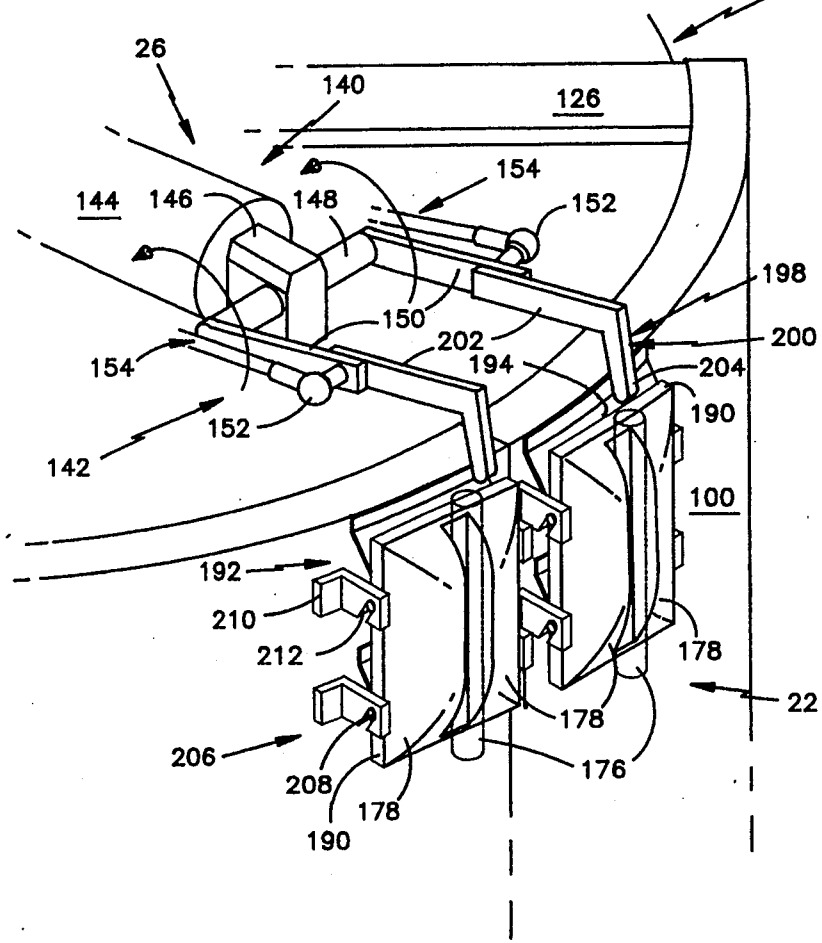
FIG. 6B is a view of the door coupling arrangement of FIG. 6A, shown in the released position.
Figure 6A:
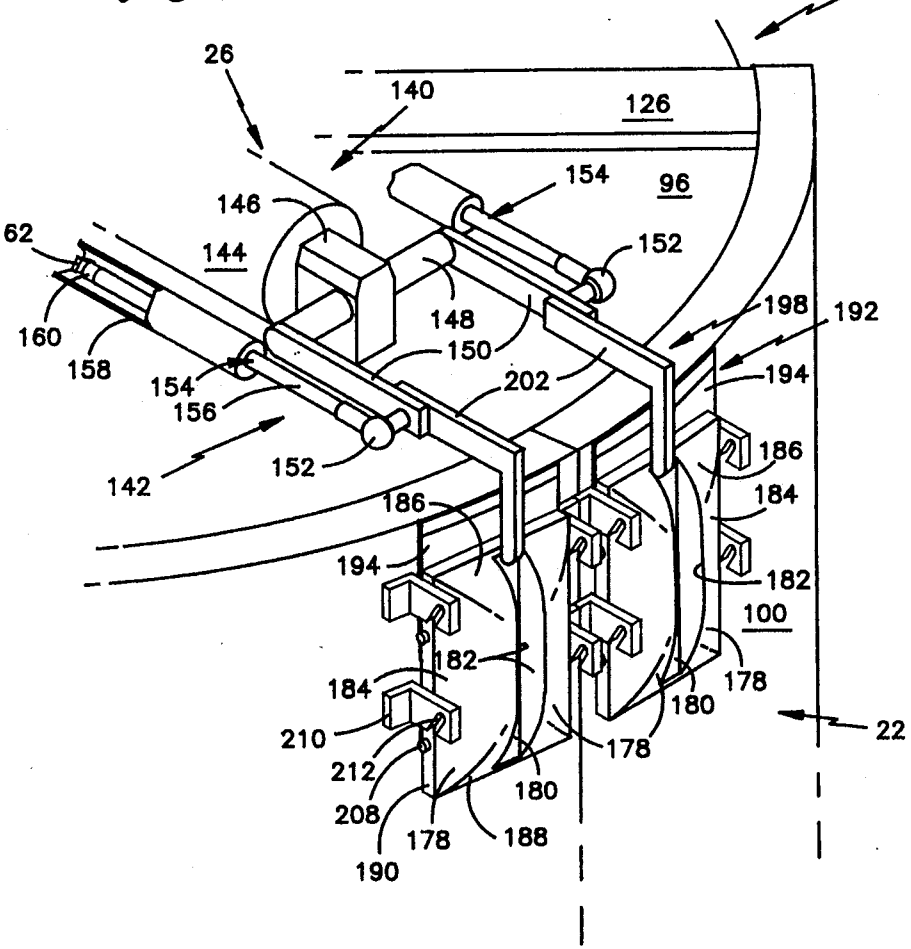
FIG. 6A is a diagrammatic view of the door coupling arrangement shown in FIG. 1, utilizing solenoids, shown in the actuated position.

Referring to FIGS. 6A and 6B, the drive 26 comprises a door operator 140 and a linkage 142. The door operator 140 comprises a reversible motor 144, a worm gear mechanism 146, a drive axle 148, and a pair of crank arms 150. As is known in the art, the worm gear 146 transmits the rotational motion of the reversible motor 144 to the drive axle 148. The crank arms 150 are attached to each end of the drive axle 148. The drive axle 148 rotates the crank arms approximately 180° from a car door closed position to a car door open position.

Referring to FIG. 4, the linkage 142 comprises four three degree of freedom couplings 152, and a pair of rods 154. Each rod 154 is attached to an end portion of a crank arm 150 and to a support arm 126,128 by a pair of the couplings 152. In the preferred embodiment the couplings 152 are ball and socket type couplings. Alternatively, the couplings 152 may comprise an elastomeric material, a universal joint, or a combination thereof (not shown). The three degree of freedom couplings 152 allow the crank arms 150 to rotate in a first plane and the support arms to rotate in a second plane while the doors 22 open and close.

Referring to FIG. 6A, in one embodiment, the rods 154 are designed to permit elongation if an overload is applied to the drive 26, such as would occur if an obstruction blocks the entryway 92 (see FIG. 4) when the doors 22 are closing. Specifically, each rod 154 comprises an inner tube 156 which may be slid axially within an outer tube 158. Under normal conditions, the inner tubes 156 are maintained a specific distance within the outer tubes 158 by, for example, small permanent magnets 160 attached to an end of the inner tubes 156 and a magnetic element 162 nested within the outer tubes 158. As long as the extending force on the rod 154 is less than the magnetic attraction of the magnet 160 and the magnetic element 162, the inner 156 and outer 158 tubes function as a single solid rod 154. If the magnetic force is exceeded, however, the inner tube 156 telescopes outwardly and lengthens the rod 154. As a result, the force transferred by the rod 154 is limited. A switch, (not shown) as is known in the detector art, may be used to detect such an extension so that the door 22 and rod 154 assembly can be reset by reversing the door operator motion, thereby returning the tubes to their shortened position. A person of ordinary skill in the art will recognize that maintaining means, other than the aforementioned magnet arrangement, may alternatively be used.

In another embodiment, the crank arms 150 may be rotated beyond the normal closing position; i.e. through a plane parallel to the ceiling 96 of the car 12. In that position, the force necessary to open the closed doors 22 without using the drive 26 would cause the rods 154 to telescope.

Hoistway/Car Door Coupling

Referring to FIG. 4, it is known in the art to provide a mechanism for coupling an elevator car door 22 to a hoistway door 18 at a particular landing 16 (see FIG. 2) before the doors 22,18 are opened at that landing. Coupling the doors 22,18 allows the car doors 22 and hoistway doors 18 to be driven by a single door drive 26. In the present invention, the mechanism comprises a vane 164, a channel 166, a mounting bracket 190 (see FIGS. 6A and 6B), and an actuator 170.

In one embodiment, the vane 164 is an elongated, relatively flat rectangular body having a first longitudinal edge 172 and a second longitudinal edge 174. The first longitudinal edge 172 of each vane is conventionally attached to the hoistway door 18 to be in the same plane as the radius of curvature of the hoistway doors 18; i.e. perpendicular to the hoistway side surface of the hoistway door 18 at that point. The second longitudinal edge 174 has chamfered edges to facilitate entry of the vane 164 within the channel 166 if the two are misaligned. The vane 164 is either constructed of or surfaced with a self-lubricating low-wear material such as an ultra high molecular weight (UHMW).

A person of skill in the art will recognize that the vane 164 may assume a variety of different geometries, such as a rod or tube 176 (see FIG. 6B) attached to the hoistway door 18, etc.

Referring to FIGS. 6A and 6B, the channel 166 is defined by two side walls 178 connected by a back wall 180. The side walls 178 are spaced apart and shaped to facilitate movement of the vane 164 into and out of the channel 166. Each side wall 178 has an inner 182 and outer 184 longitudinal surface and a top 186 and bottom end 188 surface. The outer longitudinal surfaces 184 are shaped toward the inner surfaces 182. The bottom 188 and top 186 end surfaces are shaped toward each other. In addition, the edges between the outer surfaces 184 and the top 186 and bottom end 188 surfaces are also shaped to smooth the transition between the longitudinal and end shaped surfaces. The channel 166 may be constructed of, or surfaced with, a self-lubricating low-wear material such as a UHMW polyethylene.

A mounting bracket 190, comprising means 192 for biasing the channel 166 in the direction of the vanes 164, attaches each channel 166 to a car door 22. In the preferred embodiment, the biasing means 192 is a plurality of leaf springs 194 attached at a first end to a car door 22 and a second end thereof to the mounting bracket 190. The mounting brackets 190, and attached channels 166, are positioned on the car doors 22 such that each channel 166 is in register with a respective vane 164 when the car 12 is at a landing 16.

Figure 7B:
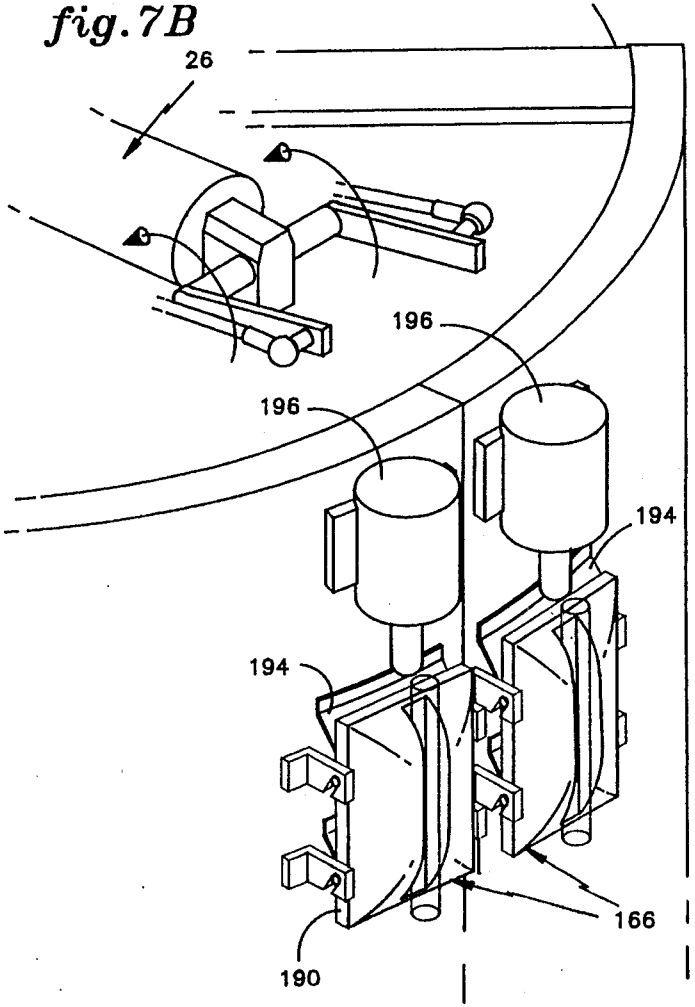
FIG. 7B is a view of the door coupling arrangement of FIG. 7A, shown in the released position.
Figure 7A:
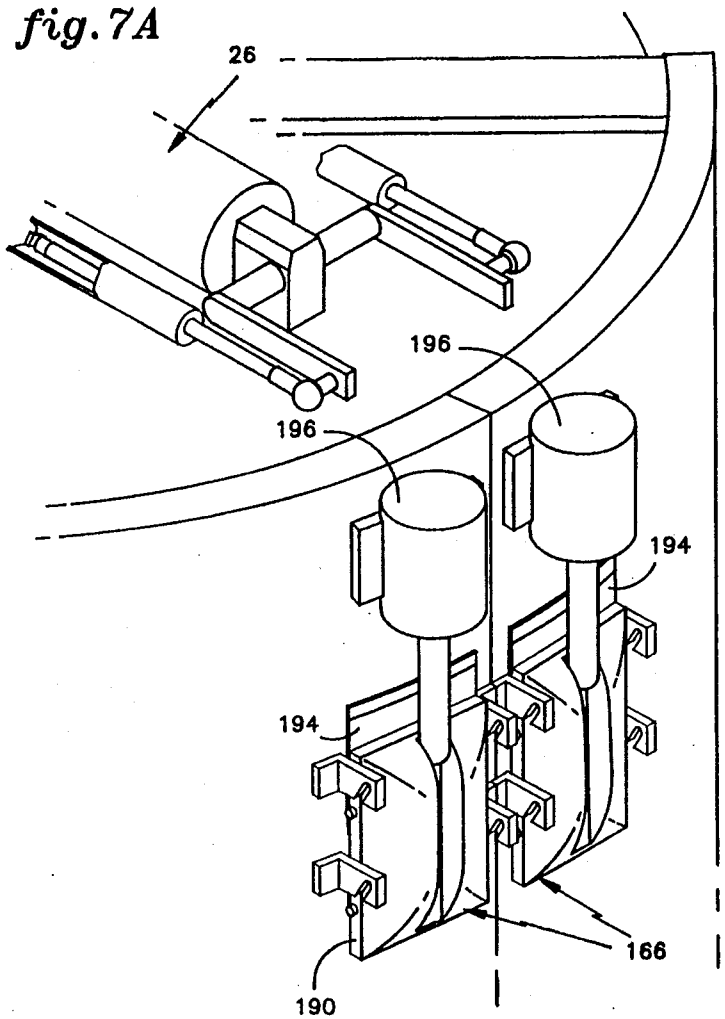
FIG. 7A is a diagrammatic view of the door coupling arrangement shown in FIG. 1, utilizing a mechanical apparatus, shown in the actuated position.

Referring to FIGS. 7A and 7B, in one embodiment, a solenoid 196 is disposed above each channel 166 for actuating the channel 166. When the car 12 (see FIG. 4) travels through the hoistway, the solenoid 196 is energized and actuates the channel 166 down and toward the car by deflecting the leaf springs 194 (see FIG. 7A). In this position, the channels 166 and the vanes 164 will not couple.

When the elevator car 12 is at a landing 16, the solenoid 196 is deenergized, thereby releasing the leaf springs 194 of the mounting bracket 190 (see FIG. 7B). The leaf springs 194 push the channel 166 upward, toward, and into engagement with the aligned vane 164 (see FIG. 4). Once the channel 166 and the vane 164 are completely coupled, the rigid connection therebetween enables the door drive 26 attached to the car door 22 to drive both the hoistway door 18 (see FIG. 4) and the car door 22.

Referring to FIGS. 6A and 6B, in another embodiment, a mechanical apparatus 198 actuates the channel 166. The apparatus includes a pair of rigid links 200, each having a first end 202 attached to a crank arm 150 and a second end 204 shaped to contact the channel 166. In the door closed position, the rigid links 200 actuate the channel 166 downward toward the car 12, thereby deflecting the leaf springs 194. In this position, the channel 166 and the vanes 164 will not couple.

When the crank arms 150 rotate up and away from the channel 166 in the door opening motion, the rigid links 200 release the channel 166. The leaf springs 194 push the channel 166 upward, toward, and into engagement with the aligned vane 164. Here again, the door drive 26 attached to the car door 22 can now drive both the hoistway door 18 and the car door 22.

In still another embodiment, means 206 for stabilizing the motion of a channel is provided including a pair of pins 208 extending out from the mounting bracket 190 on each side of the channel 166. Latch brackets 210 having slots 212 are attached to the landing side car door panels 100 adjacent the outer surfaces 184 of the channels 166. In the extended position, i.e. the position of the channel 166 when the leaf springs 194 are released, the pins 208 are received within slots 212 in the latch brackets 210. A person of ordinary skill in the art will recognize that the vane 164 and channel 166 combinations could be reversed, alternatively. For example, the channels 166 could be fixed to the hoistway doors 18 and the vanes 164 attached to mounting bracket 190 which is, in turn, attached to the car doors 22.

If the car doors 22 and hoistway doors 18 have a dissimilar radius of curvature, the vane 164 and channels 166 may need to be canted relative to their respective radii of curvature.

Hoistway Door Lock

Referring to FIG. 4, a door lock 30 is provided for each hoistway door 18 which includes a latch 214, a spring 216, a catch 218, and means 220 for uncoupling the latch 214. The catch 218 is a rod or other mechanical structure conventionally attached to either the guide 39 (or something else fixed within the hoistway) or the other hoistway door 18. The latch 214 comprises a body having a hook 221 on one end, an aperture 222 for pivotly mounting the latch 214 on the other end, a seat 224 for receiving the spring 216, and an arm 226 having a first strike plate 228. The first strike plate 228 comprises an arcuate or cammed surface. The spring seat 224 and the arm 226 are attached to the body between the two ends, on opposite sides. An axle 230 pivotly attaches the latch 214 to a flange 232 fixed to the hoistway door. The axle 230 is essentially perpendicular to a radial line from the center of curvature of the door motion.

The spring 216 acts between a seat 234 attached to the door 18 and the seat 224 attached to the latch 214, biasing the hook 221 into engagement with the catch 218. To be more specific, the hook 221 overlaps a portion of the catch 218 and the spring 216 biases the hook 221 against the catch 218. As a result, the hook 221 is either maintained in engagement with the catch 218 or biased into further engagement with the catch 218.

The means 220 for uncoupling the latch 214 and catch 218 includes a second striking plate 236 attached to the mounting bracket 190 which is attached to each car door 22. The second striking plates 236 are attached outside of the channels 166, such that they are aligned with the latches 214 attached to the hoistway doors 18. Each second striking plate 236 comprises an arcuate surface for contacting the first striking plates 228 of the respective latch 214. In the event the first 228 and second 236 striking plates are slightly misaligned, the arcuate surfaces of both accommodate the misalignment and still allow the door lock 30 to be actuated.

Operation

Referring to FIGS. 6A and 6B, as the car 12 (see FIG. 1) is raised and lowered in the hoistway 14, the leaf springs 194 supporting the channels 166 are compressed by the drive 26 and the rigid links 200 (or the solenoids 196) thereby keeping the channels 166 out of contact with the hoistway vanes 164. If the car 12 is at a landing and the doors 22,18 are to open, the drive motor 144 is signaled to rotate the crank arms 150 from the door close position to the door open position. As the arms 150 begin to rotate, either the solenoids 196 for actuating the channels 166 are deactivated, or the rigid links 200 move with the crank arms 150, thereby releasing the channels 166. As a result, the springs 194 urge the channel 166 upward, toward, and into engagement with the vane 164 (see FIG. 4) attached to the hoistway door 18. The shaped side walls 178 and end walls 186,188, enable the vane 164 and channel 166 to couple when the doors 22 are brought into position from above, below or either side.

Referring to FIG. 4, at the same time, the second strike plates 236 attached to the mounting brackets 190 of the channels 166 also move upward and toward the first strike plates 228 of the door locks 30. The second strike plates 236 contact the first strike plates 228 and pivot the latches 214 out of engagement with the catches 218, thereby releasing the hoistway door locks 30.

Referring to FIGS. 6A and 6B, still at the same time, the pins 208 extending out from the channel mounting bracket 190 are received within the slots 212 of the latch brackets 210. The pin 208 and latch 210 combinations limit the "twisting" motion of the channel 166. Twisting of the channel 166 may occur when the doors are being driven together. Twisting may also occur if the vane 164 (see FIG. 4) and channel 166 are misaligned during engagement and the vane 164 contacts one or more of the cammed surfaces of the channel side walls 178. Limiting the motion of the channel 166, therefore, facilitates movement of the vane 164 into and out of the channel 166 should the channel 166 and vane 164 be misaligned.

Referring to FIG. 4, as the crank arms 150 continue to rotate from the door closed position to the door open position, the rods 154 extending between the crank arms 150 and the support arms 126,128 urge the support arms 126,128 to rotate about the pivots 122,124. At this point, the hoistway doors 18 and the car doors 22 are coupled, and the door locks 30 are disengaged. Thus rotating the support arms 126,128 causes the attached car doors 22, and the hoistway doors 18 coupled thereto, to also rotate in a direction away from the center of the entryway 92 of the car 12.

The coupled hoistway doors 18, supported by the parallel linkages 82, both follow the curvilinear path in the guide 39 and the sill 38 and rotate slightly upwardly. Each vane 164 slides upwardly in its respective channel 166 as the hoistway doors 18 move upwardly.

Conversely, if it is desired to close the doors 22,18, the sequence of events roughly reverses. The crank arms 150 reverse rotation and act via the linkage 154 to urge the support arms 126,128 to rotate about the pivots. The support arms 126,128, in turn, urge the car doors 22 and hoistway doors 18 coupled thereto closed. The coupled hoistway doors 18, supported by the parallel linkages 82 rotate slightly downwardly and follow the curvilinear path in the guide 39 and the sill 38 toward the center of the car entryway 92. Each vane 164 slides downwardly in its respective channel 166.

As the crank arms 150 rotate into the door closed position, or slightly past the parallel plane, the doors 22,18 are closed. At this point, either the solenoid 196 (see FIGS. 7A and 7B), or the rigid links 200, actuate the channels 166 downward and away from the vanes 164, thereby uncoupling the each vane 164 and channel 166 combination. At the same time, the second striking plates 236 attached to the mounting brackets 190 of the channels 166 are actuated out of engagement with the latches 214. As a result, the springs 216 bias the latches 214 about the axles 230 and bring the hooks 221 into engagement with the catches 218, thereby locking the hoistway doors 18 closed. The car 12 (see FIG. 1) is free to move to a new landing 16.

Referring to FIG. 6A, the telescopic sliding action of the inner 156 and outer 158 tube performs two useful functions during door operation: 1) the action prevents the transfer of excessive force to a passenger who may be struck, and simultaneously allows for the absorption of kinetic energy at low force levels in the structure; 2) the limited controlled breakaway force allows a passenger to open the door 22,18 when the car 12 is near a landing 16, without requiring reverse rotation of the door drive 26. This is significant because a worm wheel/worm drive is often not back-driveable, and the ability to open a door 22,18 manually without power is generally required under specific conditions by Elevator Codes. The telescopic action is also required because manual door reopening may be needed when the crank arms are at or near over center, where force from the door cannot rotate them.

While the present invention has been illustrated and described with respect to a particularly preferred embodiment thereof, it will be appreciated by those skilled in the art that various other changes, omissions, and additions in the form and detail thereof may be made therein without departing from the spirit and scope of the invention.

One of ordinary skill in the art will further appreciate that the present invention may be utilized in other door systems than elevator door systems.

One of ordinary skill in the art will recognize that: these doors may have utility for use with other types of enclosures than elevators; that the parallel linkage may be used with flat doors; and that the parallel linkage may also used with the car doors.

We claim:

1. An elevator landing for use with a curvilinear hoistway door comprising:

a lintel, a guide disposed upon said lintel said guide having a curvilinear first slot having an inner edge and an outer edge for guiding an upper portion of said curvilinear door and, a curvilinear sill having a curvilinear second slot having an inner edge and an outer edge for guiding a lower edge portion of said door, said first slot and said second slot being in register with each other and wherein said second slot extends vertically through said sill.

2. An elevator landing for use with a hoistway door comprising:

a lintel, a guide disposed upon said lintel, said guide having a first slot having an inner edge and an outer edge for guiding an upper portion of said door, said first slot permitting upward motion of said upper portion of said door, and a sill having a second slot having an inner edge and an outer edge for guiding a lower edge portion of said door, said second slot permitting downward motion of said lower portion of said door, said first slot and said second slot being in register with each other.

3. An elevator landing for use with a hoistway door comprising:

a lintel, a guide disposed upon said lintel said guide having a first slot having an inner edge and an outer edge for guiding an upper portion of said door and, a sill having a second slot having an inner edge and an outer edge for guiding a lower edge portion of said door, said first slot and said second slot being in register with each other, and wherein said second slot extends vertically through said sill.

4. An elevator landing for use with a hoistway door comprising:

a lintel, a guide disposed upon said lintel, said guide having a first slot having an inner edge and an outer edge for guiding an upper portion of said door, said inner and outer edges contacting said door normal to a path of said door to permit upward motion of said upper portion of said door, and, a sill having a second slot having an inner edge and an outer edge for guiding a lower edge portion of said door, said inner and outer edges contacting said door normal to a path of said door to permit downward motion of said lower portion of said door, said first slot and said second slot being in register with each other.

5. An doorway for use with a door comprising:

a lintel, a guide disposed upon said lintel said guide having a first slot having an inner edge and an outer edge for guiding an upper portion of said door said inner and outer edges contacting said door normal to a path of said door to permit upward motion of said upper portion of said door, and, a sill having a second slot having an inner edge and an outer edge for guiding a lower edge portion of said door said inner and outer edges contacting said door normal to a path of said door to permit downward motion of said lower portion of said door, said first slot and said second slot being in register with each other.

6. The elevator landing according to claim 2, wherein said hoistway door, said first slot, and said second slot are curvilinear.

7. The elevator landing according to claim 6, wherein said lintel is curvilinear.

8. The elevator landing according to claim 4, wherein said hoistway door, said first slot, and said second slot are curvilinear.

9. The elevator landing according to claim 8, wherein said lintel is curvilinear.

10. The doorway according to claim 5, wherein said doorway, said first slot, and said second slot are curvilinear.

11. The doorway according to claim 10, wherein said lintel is curvilinear.

12. The elevator landing according to claim 2, further including means to support said door for motion along a path, said support means providing both upward and downward motion of the door along the path.

13. The elevator landing according to claim 4, further including means to support said door for motion along a path, said support means providing both upward and downward motion of the door along the path.

14. The elevator landing according to claim 5, further including means to support said door for motion along a path, said support means providing both upward and downward motion of the door along the path.

* * * * *